US012729876B2

(12) United States Patent
Kobata et al.

(10) Patent No.: US 12,729,876 B2
(45) Date of Patent: Sep. 8, 2026

(54) RELAY UNIT AND AIR-CONDITIONING APPARATUS INCLUDING RELAY UNIT

(71) Applicant: Mitsubishi Electric Corporation, Tokyo (JP)

(72) Inventors: Hiroaki Kobata, Tokyo (JP); Hiroki Takahashi, Tokyo (JP); Hiroki Washiyama, Tokyo (JP); Ryosuke Matsui, Tokyo (JP); Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 274 days.

(21) Appl. No.: 18/567,080

(22) PCT Filed: Aug. 5, 2021

(86) PCT No.: PCT/JP2021/029046
§ 371 (c)(1),
(2) Date: Dec. 5, 2023

(87) PCT Pub. No.: WO2023/012957
PCT Pub. Date: Feb. 9, 2023

(65) Prior Publication Data

US 2024/0271822 A1 Aug. 15, 2024

(51) Int. Cl.
*F24F 13/22* (2006.01)
*F24F 13/20* (2006.01)

(52) U.S. Cl.
CPC ..... *F24F 13/222* (2013.01); *F24F 13/20* (2013.01); *F24F 2013/227* (2013.01)

(58) Field of Classification Search
CPC ..... F24F 13/20; F24F 13/22; F24F 13/222; F24F 5/0003; F24F 2013/227; F16K 27/003
See application file for complete search history.

(56) References Cited

U.S. PATENT DOCUMENTS 5,511,386 A 4/1996 Russ et al.
5,715,697 A 2/1998 Rust, Jr. et al.
(Continued)

FOREIGN PATENT DOCUMENTS

JP H02195124 A * 8/1990
JP 2012013404 A * 1/2012
JP 2013-011408 A 1/2013

OTHER PUBLICATIONS

Extended European Search Report dated Aug. 8, 2024 issued in corresponding European Patent Application No. 21952782.7.
(Continued)

*Primary Examiner* — Frantz F Jules
*Assistant Examiner* — Martha Tadesse
(74) *Attorney, Agent, or Firm* — Posz Law Group, PLC

(57) ABSTRACT

A relay unit includes a housing having a lower portion having four side faces each having an outlet; a heat exchanger accommodated in the housing; and a drain pan located below the heat exchanger. At a front face of the lower portion of the housing, a removable sheet metal cover having the outlet is formed. The drain pan includes a plate having four side portions, a side wall portion extending upward from each of the four side portions, and a drain socket provided in the side wall portion located forward or rearward, and to which a drain hose is connected. The drain pan is freely inserted and removed in a front-rear direction in a state in which the sheet metal cover is removed from the housing, and the drain pan is freely reversed front to rear to be accommodated in the housing.

16 Claims, 13 Drawing Sheets

(56) References Cited

U.S. PATENT DOCUMENTS

| | | | | |
|---|---|---|---|---|
| 5,791,156 | A * | 8/1998 | Strautman | B60H 1/00364 296/38 |
| 2016/0084547 | A1* | 3/2016 | Nishioka | F24F 13/222 165/110 |

OTHER PUBLICATIONS

International Search Report of the International Searching Authority mailed Oct. 12, 2021 for the corresponding International Application No. PCT/JP2021/029046 (and English translation).
Office Action mailed on May 15, 2026 for the corresponding European patent application No. 21952782.7.

* cited by examiner

RELAY UNIT AND AIR-CONDITIONING APPARATUS INCLUDING RELAY UNIT

CROSS REFERENCE TO RELATED APPLICATION

This application is a U.S. national stage application of PCT/JP2021/029046 filed on Aug. 5, 2021, the contents of which are incorporated herein by reference.

TECHNICAL FIELD

The present disclosure relates to a relay unit having a drain pan and also to an air-conditioning apparatus including the relay unit.

BACKGROUND ART

In general, in an air-conditioning apparatus such as a floor-standing air-conditioning apparatus, a position where a pipe is provided may be varied depending on the type of building and the location where the air-conditioning apparatus is installed. It is thus necessary to change a direction in which drain water is discharged depending on the position of the pipe provided. This involves pulling out a drain pan and doing burdensome work. In view of this state, a drain pan has been proposed that does not require burdensome work (see, for example, Patent Literature 1). The drain pan disclosed in Patent Literature 1 is located below a heat exchanger in a housing of a floor-standing air-conditioning apparatus. The drain pan has a box shape provided with left and right drainpipes. Inside this drain pan, a sloped plate having a plurality of communication openings is provided and partitioning the interior of the drain pan into an upper layer portion and a lower layer portion. A blind cap is fitted over each of the communication openings. A stopper is fitted into one of the drainpipes that is not in use.

When the pipe is provided on the right side of the housing, the blind cap remains fitted, and the right-side drainpipe is connected to the pipe, while the left-side drainpipe is provided with the stopper. When the pipe is provided on the left side of the housing, the blind cap is removed from each of the communication openings, and the left-side drainpipe is connected to the pipe, while the right-side drainpipe is provided with the stopper. This allows drain water to be discharged in a direction that can be changed to either the leftward or rightward direction of the housing. This eliminates the need for pulling out the drain pan and doing burdensome work regardless of whether the pipe is provided on either the left side or the right side of the housing.

CITATION LIST

Patent Literature

Patent Literature 1: Japanese Unexamined Patent Application Publication No. H02-195124

SUMMARY OF INVENTION

Technical Problem

An air-conditioning apparatus such as a floor-standing air-conditioning apparatus may not have a sufficient space on the left side or the right side of the housing, depending on the type of building and the location where the air-conditioning apparatus is installed. It is thus necessary to provide the pipe on the front side or the rear side of the housing and discharge the drain water from the front side or the rear side of the housing. However, the drain pan in Patent Literature 1 can only cope with a case where the drain water is discharged from the left side or the right side of the housing. There is still a problem in that the air-conditioning apparatus cannot be installed at a location that requires the drain water to be discharged from the front side or the rear side of the housing.

The present disclosure has been made to solve the above problems, and it is an object of the present disclosure to provide a relay unit that can still be installed without involving burdensome work even at a location that requires drain water to be discharged from a front side or a rear side of a housing, and to provide an air-conditioning apparatus including the relay unit.

Solution to Problem

A relay unit according to one embodiment of the present disclosure includes a housing with a box shape, the housing having a lower portion having four side faces and an outlet formed in each of the four side faces; a heat exchanger accommodated in the housing; and a drain pan located below the heat exchanger to receive drain water. At a front face of the lower portion of the housing, a sheet metal cover in which the outlet is formed is provided such that the sheet metal cover is removable, the drain pan includes a plate with a rectangular shape, the plate having four side portions, a side wall portion extending upward from each of the four side portions of the plate, and a drain socket provided in the side wall portion located forward or rearward, and to which a drain hose is connected, the drain pan is accommodated in the housing such that the drain pan is freely inserted and removed in a front-rear direction in a state in which the sheet metal cover is removed from the housing, and the drain pan is freely reversed front to rear to be accommodated in the housing.

An air-conditioning apparatus according to another embodiment of the present disclosure includes a heat source side unit configured to generate a heat source; a load side unit configured to use the heat source generated by the heat source side unit; and the above relay unit.

Advantageous Effects of Invention

In the relay unit according to an embodiment of the present disclosure and the air-conditioning apparatus including the relay unit, the outlets are formed individually in the four side faces of the lower portion of the housing. At the time of accommodating the drain pan in the housing in a state in which the sheet metal cover is removed from the housing, the drain pan is freely reversed front to rear to be accommodated in the housing. Therefore, the drain pan can be reversed front to rear so that the drain hose connected to the drain socket of the drain pan can be led out through either the outlet in the front face or the outlet in the rear face of the housing. As a result, even at a location that requires the drain water to be discharged from the front side or rear side of the housing, the relay unit can still be installed without involving burdensome work.

DESCRIPTION OF EMBODIMENTS

Figure 1:
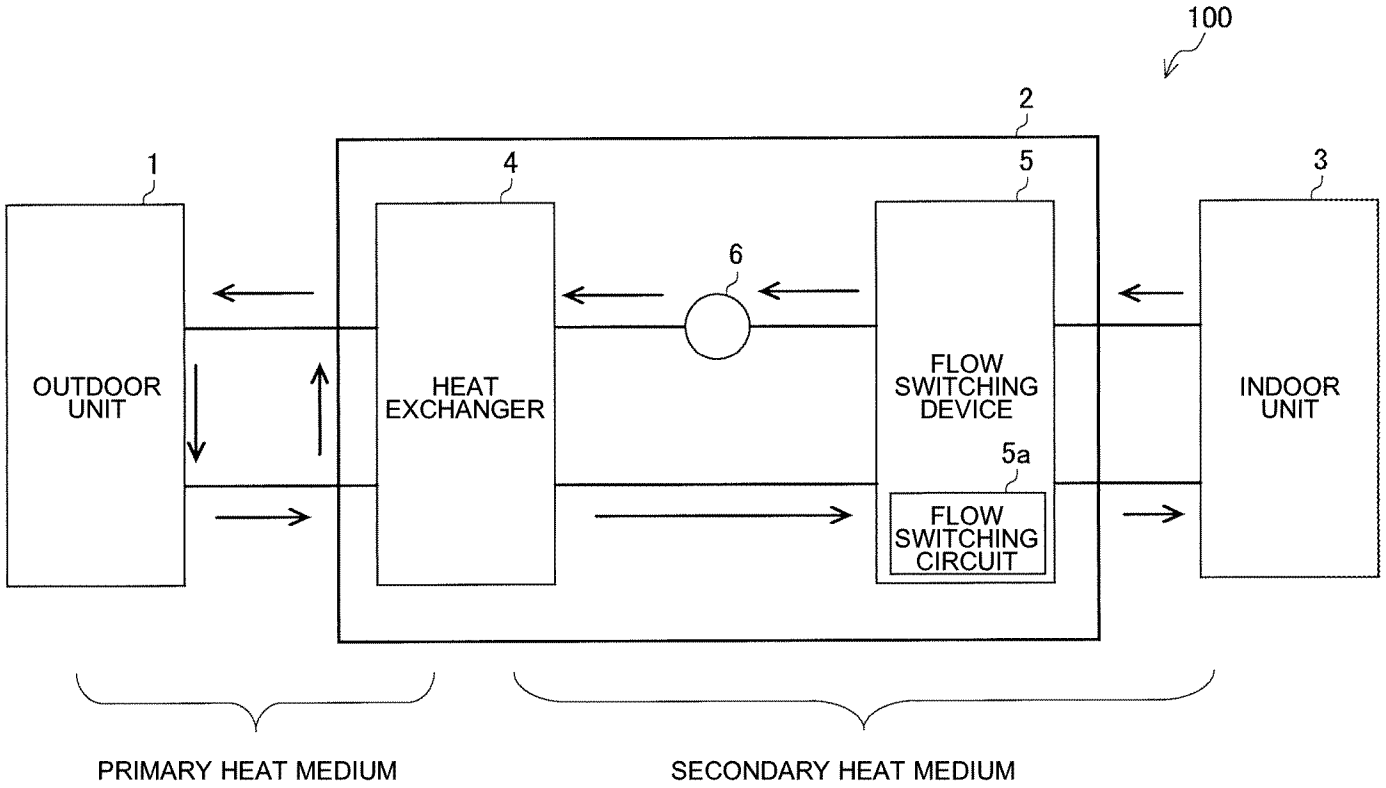
FIG. 1 illustrates the schematic configuration of a heat medium circulation circuit in an air-conditioning apparatus including a relay unit according to Embodiment 1.

Hereinafter, a relay unit 2 according to Embodiment 1 and an air-conditioning apparatus 100 will be described with reference to the drawings. Note that the present disclosure is not limited by Embodiment 1 described below. In addition, the relationship of sizes of the components in the drawings described below may differ from that of actual ones. In the descriptions below, terms that represent directions (for example, "up." "down," "right," "left," "front," and "rear") are appropriately used for the sake of easy understanding. However, these terms are used merely for description purposes, and are not intended to limit the present disclosure. These terms that represent directions refer to the directions when the relay unit 2 is viewed from the front face (when the relay unit 2 is viewed in the Y-axis arrow direction in FIG. 1) unless otherwise specified. In the drawings below, the same reference signs denote the same or equivalent components, which are common throughout the entire specification.

Embodiment 1

FIG. 1 illustrates the schematic configuration of a heat medium circulation circuit in the air-conditioning apparatus 100 including the relay unit 2 according to Embodiment 1.

As illustrated in FIG. 1, the air-conditioning apparatus 100 includes an outdoor unit 1 that is a heat source side unit configured to generate a heat source, an indoor unit 3 that is a load side unit configured to use the heat source, and the relay unit 2 that is a heat medium conversion device provided between the outdoor unit 1 and the indoor unit 3. Note that a plurality of the indoor units 3 may be provided.

The relay unit 2 includes a heat exchanger 4, a flow switching device 5, and a pump 6.

Through the heat exchanger 4, a primary heat medium that is refrigerant supplied from the outdoor unit 1 exchanges heat with a secondary heat medium that is water or antifreeze flowing to and from the indoor unit 3.

In FIG. 1, the flow switching device 5 includes a flow switching circuit 5*a*. The flow switching circuit 5*a* switches between flow passages through which the secondary heat medium, having exchanged heat in the heat exchanger 4, flows to the indoor unit 3 to allow the secondary heat medium from the heat exchanger 4 to flow to at least one of the indoor units 3. The flow switching circuit 5*a* allows the secondary heat medium from at least one of the indoor units 3 to flow to the pump 6. The pump 6 pressurizes the secondary heat medium from the flow switching device 5 to allow the secondary heat medium to circulate, and then outputs the pressurized secondary heat medium to the heat exchanger 4. The flow switching circuit 5*a* is formed by a single type of valve or a combination of multiple types of valves, such as a four-way valve, a solenoid valve, a check valve, a can-body protection valve, a three-way valve, and a valve block. Note that the valve block described above includes a valve provided in a pipe of the flow switching circuit 5*a* that allows the secondary heat medium from the heat exchanger 4 in the flow switching circuit 5*a* to flow to at least one of the indoor units 3.

Next, a flow of the heat medium in the air-conditioning apparatus 100 is described.

Initially, the primary heat medium transfers heat or receives heat in the outdoor unit 1 and then flows into the relay unit 2. The primary heat medium and the secondary heat medium flowing into the heat exchanger 4 exchange heat with each other. Thereafter, the primary heat medium flows out from the relay unit 2 and flows back to the outdoor unit 1 again.

The secondary heat medium circulates between the relay unit 2 and the indoor unit 3 through the pump 6. At this time, the secondary heat medium is heated or cooled by the primary heat medium in the heat exchanger 4. Then, the secondary heat medium flows to at least one of the indoor units 3 via the flow switching device 5 to transfer heat to or receive heat from air in a target space in a use side heat exchanger. Thereafter, the secondary heat medium flows back to the heat exchanger 4 via the flow switching device 5.

Figure 2:
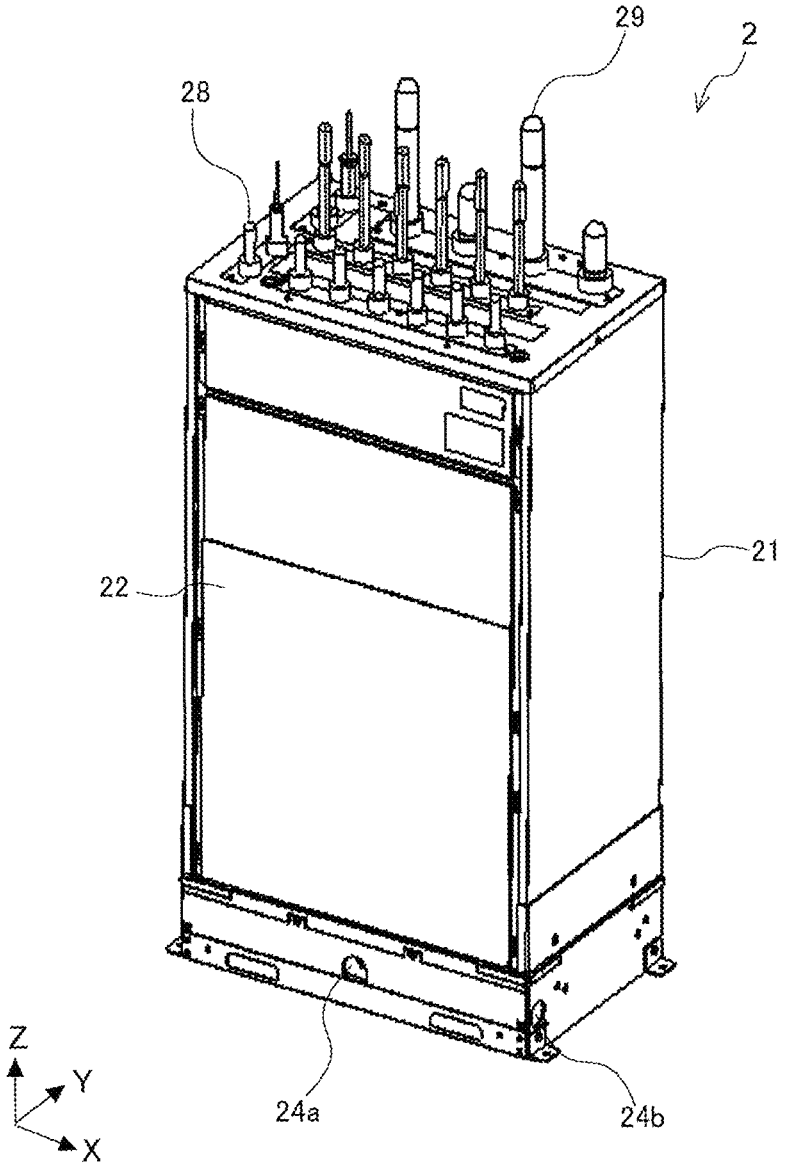
FIG. 2 is an exterior perspective view of the relay unit according to Embodiment 1 when the relay unit is viewed from the front.
Figure 3:
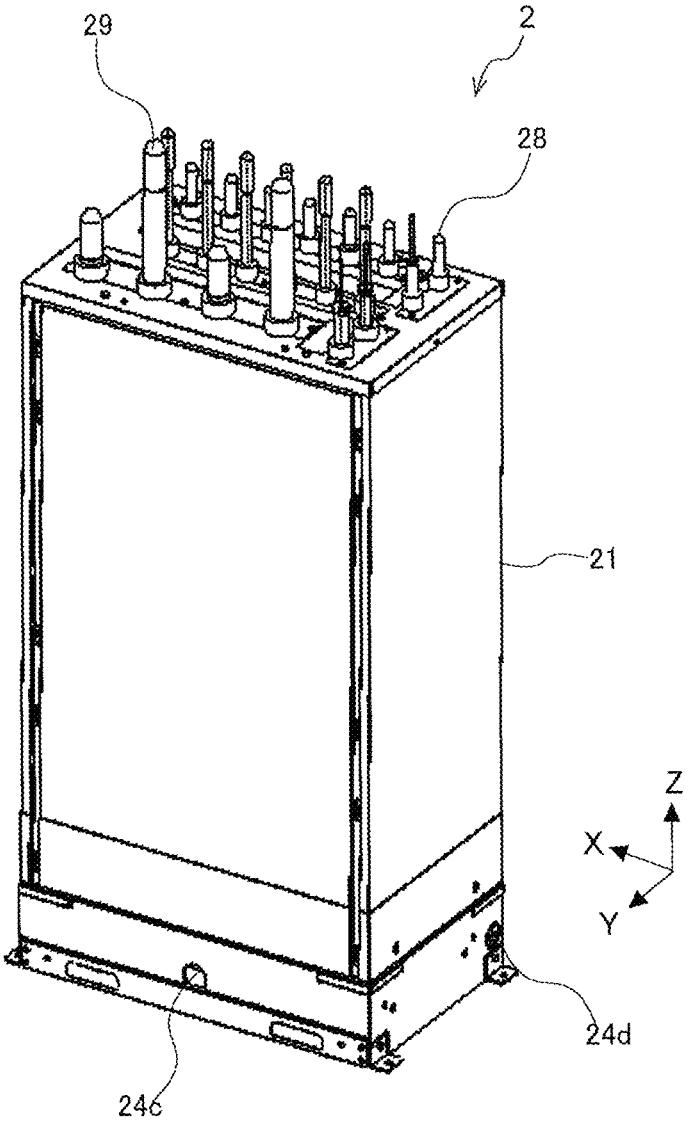
FIG. 3 is an exterior perspective view of the relay unit according to Embodiment 1 when the relay unit is viewed from the rear.
Figure 4:
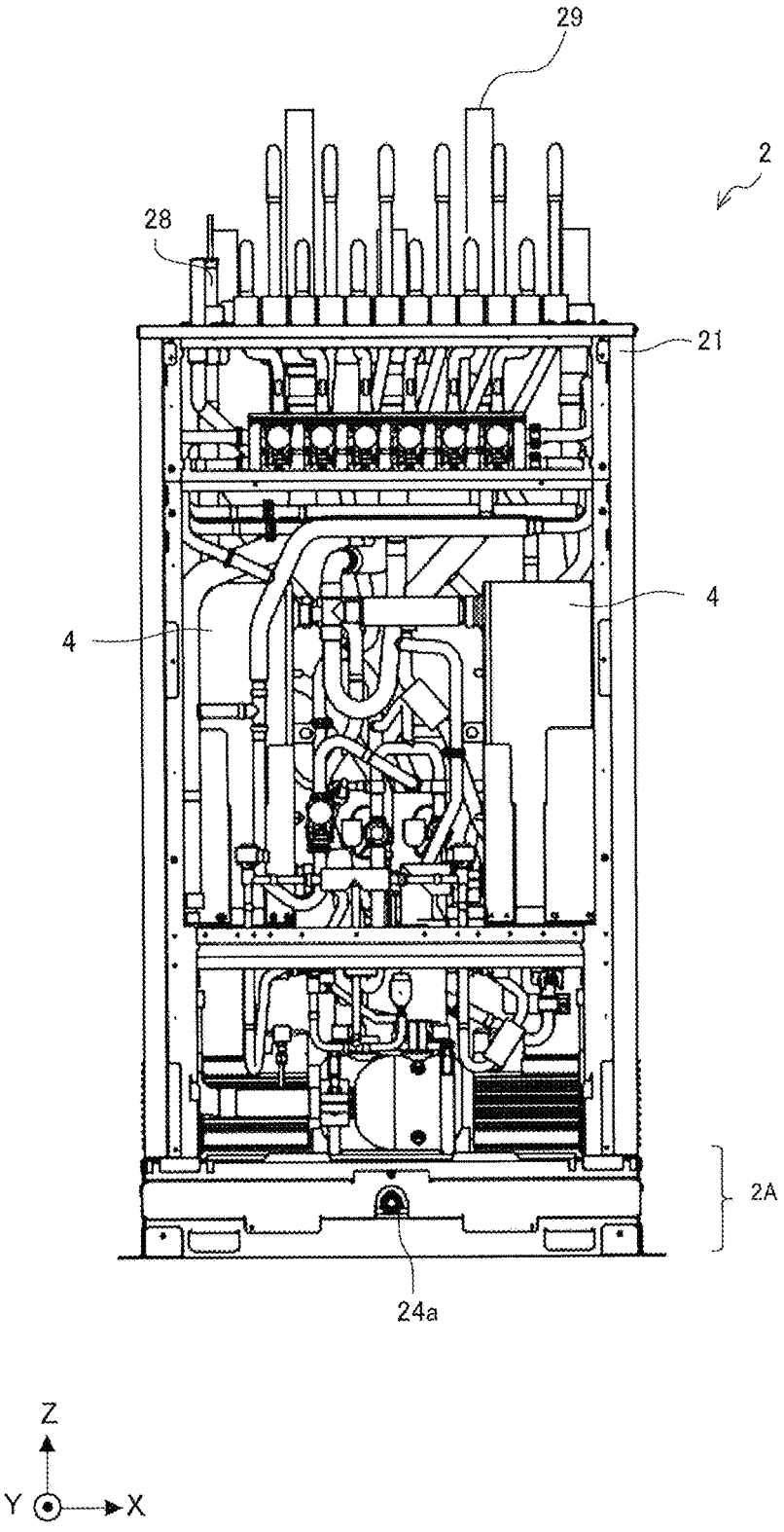
FIG. 4 is a schematic diagram of the relay unit according to Embodiment 1 with its front panel removed, when the relay unit is viewed from the front.

FIG. 2 is an exterior perspective view of the relay unit 2 according to Embodiment 1 when the relay unit 2 is viewed from the front. FIG. 3 is an exterior perspective view of the relay unit 2 according to Embodiment 1 when the relay unit 2 is viewed from the rear. FIG. 4 is a schematic diagram of the relay unit 2 according to Embodiment 1 with its front panel 22 removed, when the relay unit 2 is viewed from the front.

As illustrated in FIGS. 2 and 3, the relay unit 2 includes a housing 21 with a cuboid shape. The front panel 22 is provided at the front face of the housing 21. As illustrated in FIG. 4, the front panel 22 is formed to be removable from the housing 21 such that a worker can maintain components located in the relay unit 2, such as the heat exchanger 4.

As illustrated in FIGS. 2 and 3, outlets are formed individually in the four side faces of a lower portion of the housing 21. Specifically, a front-face drain outlet 24*a* is formed in the front face of the lower portion of the housing 21. A right-face drain outlet 24*b* is formed in the right face of the lower portion of the housing 21. A rear-face drain outlet 24*c* is formed in the rear face of the lower portion of the housing 21. A left-face drain outlet 24*d* is formed in the left face of the lower portion of the housing 21.

A plurality of primary heat medium pipes 28 and a plurality of secondary heat medium pipes 29 are provided on the top side of the housing 21, each of which extends toward a direction (the Z-axis arrow direction) opposite to the gravity direction.

Figure 5:
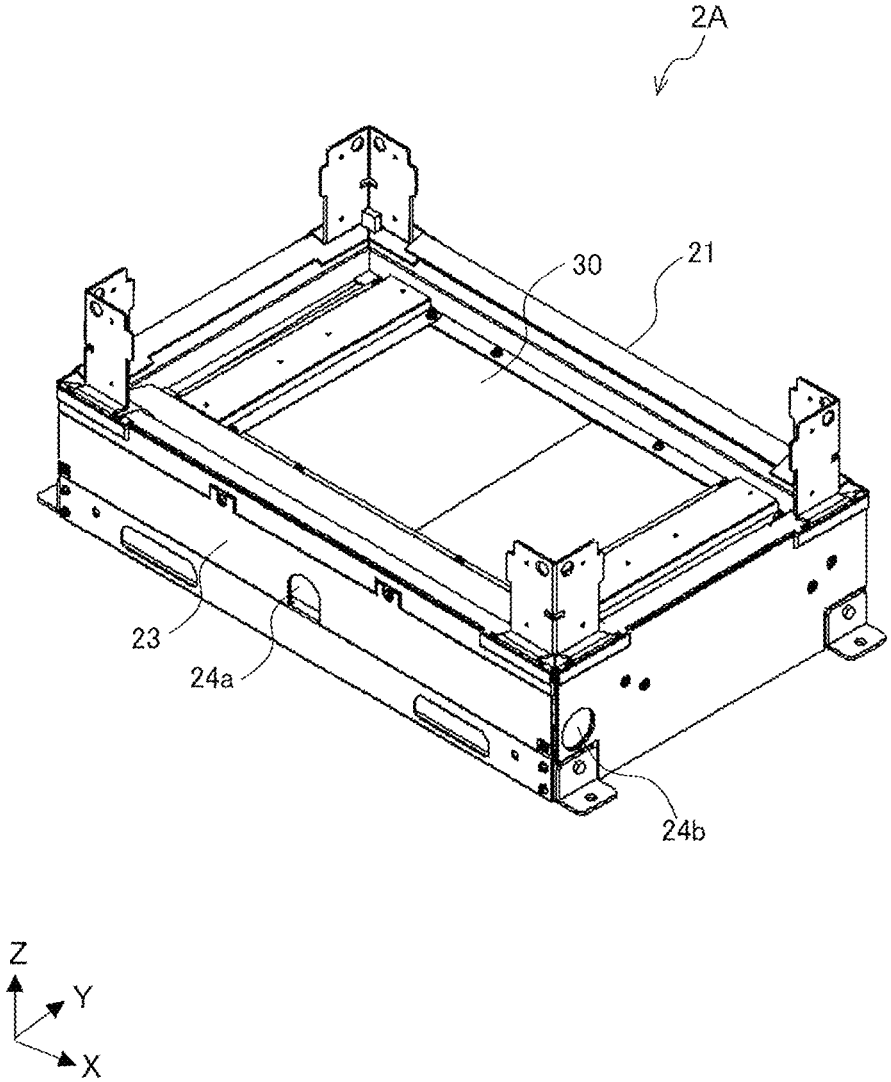
FIG. 5 is a perspective view of a lower portion of the relay unit illustrated in FIG. 4.
Figure 6:
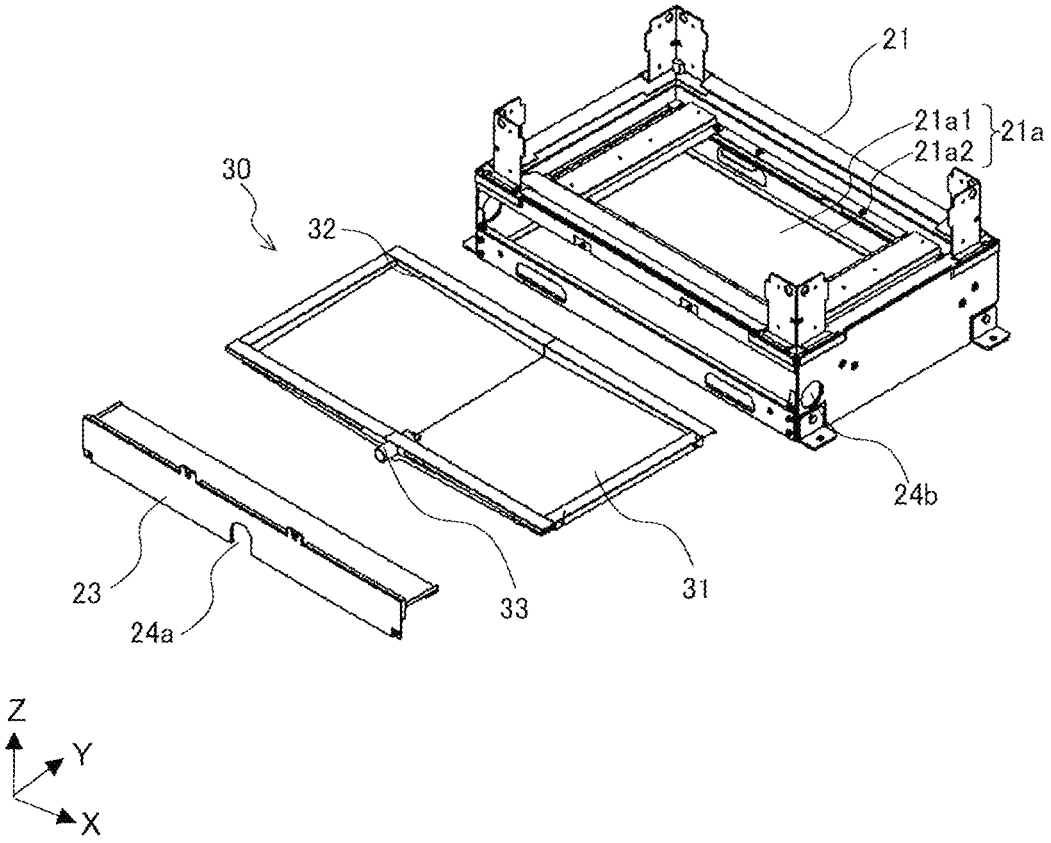
FIG. 6 is an exploded perspective view of the lower portion of the relay unit illustrated in FIG. 4.
Figure 7:
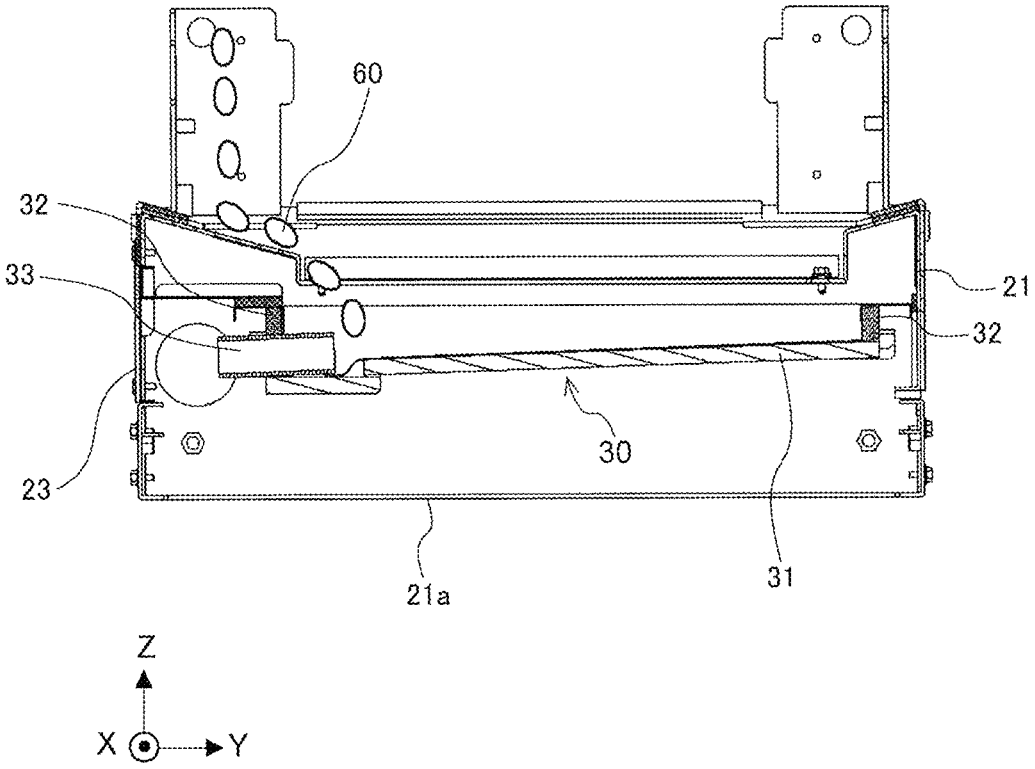
FIG. 7 is a schematic diagram illustrating the vertical cross section of the lower portion of the relay unit illustrated in FIG. 4 in side view.
Figure 8:
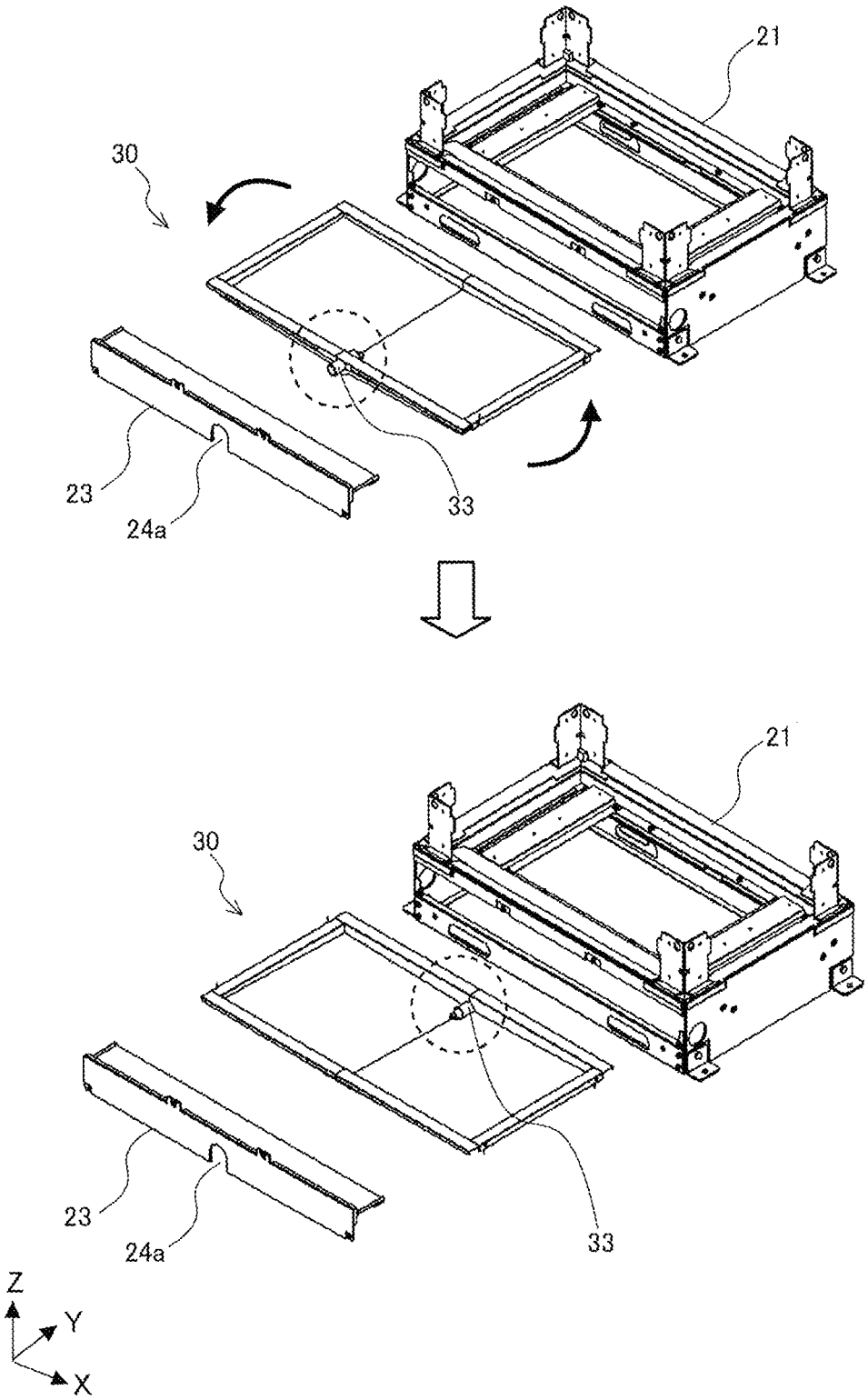
FIG. 8 includes exploded perspective views of the lower portion of the relay unit according to Embodiment 1 in a state in which a drain pan is reversed.
Figure 9:
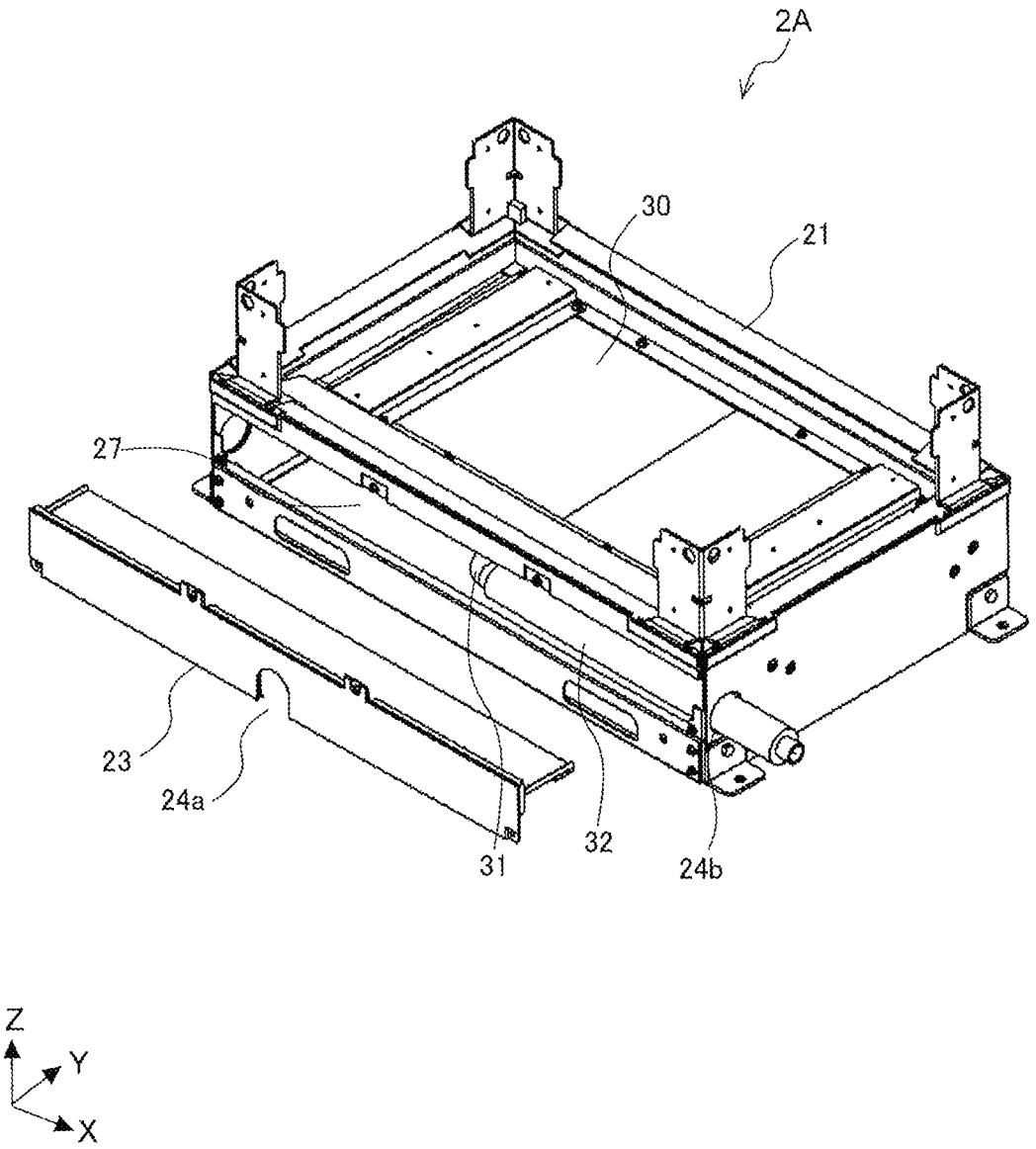
FIG. 9 is an exploded perspective view of the lower portion of the relay unit according to Embodiment 1 when a drain hose is led out through the right face.
Figure 10:
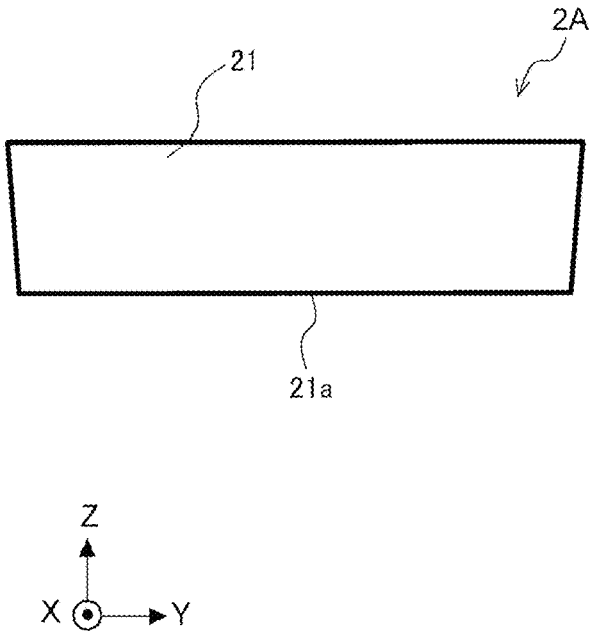
FIG. 10 is a schematic diagram illustrating the lower portion of the relay unit illustrated in FIG. 4 in side view.

FIG. 5 is a perspective view of a lower portion 2A of the relay unit 2 illustrated in FIG. 4. FIG. 6 is an exploded perspective view of the lower portion 2A of the relay unit 2 illustrated in FIG. 4. FIG. 7 is a schematic diagram illustrating the vertical cross section of the lower portion 2A of the relay unit 2 illustrated in FIG. 4 in side view. FIG. 8 includes exploded perspective views of the lower portion 2A of the relay unit 2 according to Embodiment 1 in a state in which a drain pan 30 is reversed. FIG. 9 is an exploded perspective view of the lower portion 2A of the relay unit 2 according to Embodiment 1 when a drain hose is led out through the right face. FIG. 10 is a schematic diagram illustrating the lower portion 2A of the relay unit 2 illustrated in FIG. 4 in side view.

As illustrated in FIG. 5, the drain pan 30 is provided in the lower portion 2A of the relay unit 2. As illustrated in FIG. 6, the drain pan 30 includes a plate 31 with a rectangular shape, side wall portions 32, each of which extends upward from the corresponding one of the four side portions of the plate 31, and a drain socket 33 provided at the laterally central portion of one of the four side wall portions 32 and to which a drain hose 36 is connected (see FIG. 11 and other reference described later). As illustrated in FIG. 7, the drain pan 30 is located above a bottom face 21*a* of the housing 21, and is to accumulate drain water 60 that is produced because of condensation formed on the surface of the heat exchanger 4 located in the housing 21. As illustrated in FIG. 6, the bottom face 21*a* of the housing 21 is made up of a lower end portion 21*a*2 of the four side faces of the lower portion of the housing 21, and a hollow portion 21*a*1 on the inner side of the lower end portion 21*a*2. That is, the hollow portion 21*a*1 is formed in the bottom face 21*a* of the housing 21.

As illustrated in FIG. 10, the lower portion of the housing 21 has a water guide structure that is inclined inward as the four side faces extend toward the bottom face 21*a*. While FIG. 10 illustrates the water guide structure of the lower portion of the housing 21 only on the front and rear faces of the four side faces, the lower portion of the housing 21 also has the same water guide structure on the right and left faces. This water guide structure allows the drain water 60 produced in the housing 21 to be all guided to the drain pan 30 located in the lower portion of the housing 21. Even though a component of the relay unit 2 is not located immediately above the drain pan 30, it is still possible to guide the drain water 60 produced on the component to the drain pan 30.

As illustrated in FIG. 5, a sheet metal cover 23 is provided at the front face of the lower portion of the housing 21. That is, the sheet metal cover 23 is provided below the front panel 22. As illustrated in FIG. 6, the sheet metal cover 23 is formed to be removable from the housing 21. The front-face drain outlet 24*a* described above is formed in the sheet metal cover 23.

The drain pan 30 is accommodated in the housing 21 such that the drain pan 30 is supported from below by a support portion (not illustrated) in the housing 21. As illustrated in FIG. 6, in a state in which the sheet metal cover 23 is removed from the housing 21, a worker pulls the drain pan 30 forward (in a direction opposite to the Y-axis arrow direction) to slide it through the housing 21, and can thereby remove it from the housing 21. Further, in a state in which the sheet metal cover 23 is removed from the housing 21, a worker pushes the drain pan 30 rearward (in the Y-axis arrow direction) to slide the drain pan 30 through the housing 21 and can thereby accommodate it in the housing 21. In the manner as described above, the drain pan 30 has a structure that is slidable in the front-rear direction so that the drain pan 30 can be easily removed from the housing 21. This can facilitate cleaning and replacement of the drain pan 30 and other work.

The drain pan 30 has an outer shape that is nearly symmetrical in the front-rear direction. As illustrated in FIG. 8, the drain pan 30 can be reversed front to rear to be accommodated in the housing 21. That is, the drain pan 30 can be accommodated in the housing 21 such that the drain socket 33 is located forward. In addition, the drain pan 30 can also be accommodated in the housing 21 such that the drain socket 33 is located rearward.

As illustrated in FIG. 8, the front-face drain outlet 24*a* in the sheet metal cover 23 is formed at a location where the front-face drain outlet 24*a* faces the drain socket 33 in a state in which the drain pan 30 is accommodated in the housing 21 such that the drain socket 33 is located forward. Although not illustrated, the rear-face drain outlet 24*c* in the lower portion of the housing 21 is formed at a location where the rear-face drain outlet 24*c* faces the drain socket 33 in a state in which the drain pan 30 is accommodated in the housing 21 such that the drain socket 33 is located rearward. This structure allows the drain hose 36 to be led out to the outside of the housing 21 through the front-face drain outlet 24*a* or the rear-face drain outlet 24*c* by possibly minimally routing the drain hose 36 in the housing 21.

As illustrated in FIG. 7, the bottom of the drain pan 30, that is, the plate 31 is provided with a downward slope toward the drain socket 33. Specifically, in a state in which the drain pan 30 is accommodated in the housing 21 such that the drain socket 33 is located forward, the plate 31 is inclined downward from the side wall portion 32 on the rear side toward the side wall portion 32 on the front side in which the drain socket 33 is provided. Further, the plate 31 is inclined downward from the side wall portions 32 on the left and right sides toward the central portion. This structure helps easily guide the drain water 60 accumulating on the plate 31 to the drain socket 33. Even when the drain socket 33 is provided in only one of the four side wall portions 32, it is still possible to discharge the drain water 60 from the drain socket 33. Furthermore, regardless of the orientation of the drain pan 30 accommodated in the housing 21, it is possible to guide the drain water 60 accumulating on the plate 31 to the drain socket 33.

The area of the drain pan 30 in plan view is smaller than the area of the bottom face 21*a* of the housing 21 that is a contact area of the relay unit 2. With this structure, the drain pan 30 can be downsized and be reduced in weight, which helps a worker to easily remove the drain pan 30 from the housing 21 at the time of maintenance. Even though the area of the drain pan 30 is decreased, the water guide structure of the housing 21 still allows the drain water 60 produced in the housing 21 to be all guided to the drain pan 30 located in the lower portion of the housing 21.

As illustrated in FIG. 7, the drain socket 33 is accommodated in the housing 21. As illustrated in FIGS. 2 and 3, the relay unit 2 has such a structure that only the drain hose 36 protrudes from one of the four side faces of the lower portion of the housing 21. Consequently, in the relay unit 2 according to Embodiment 1, it is possible to bring all the three side faces, other than the one side face from which the drain hose 36 protrudes, into contact with the wall surfaces. The relay unit 2 can thus be installed even in a narrow space surrounded by walls, for example, a space defined by a partially-recessed wall of a building.

As illustrated in FIG. 9, a space 27 whose diameter is greater than or equal to the outer diameter of the drain hose 36 (for example, several tens of millimeters) is provided between the drain pan 30 and the sheet metal cover 23. The space 27 is provided in the housing 21 on the forward side of the lower portion so that the space 27 can be used to run the drain hose 36 in the housing 21 in the left-right direction. Thus, the drain hose 36 runs through the space 27 in a state in which the drain pan 30 is accommodated in the housing 21 such that the drain socket 33 is located forward so that it is possible to lead out the drain hose 36 through either selected one of the right-face drain outlet 24*b* and the left-face drain outlet 24*d* in the lower portion of the housing 21. As a result, it is unnecessary to accommodate the drain pan 30 in the housing 21 such that the drain socket 33 is located toward the right face or the left face.

It is also unnecessary to run the drain hose 36 along the outside of the housing 21. This eliminates the need for securing the space on the outside of the housing 21 to run the drain hose 36. The right-face drain outlet 24*b* and the left-face drain outlet 24*d* are formed on the forward side of the lower portion of the housing 21. This structure allows the drain hose 36 to be led out to the outside of the housing 21 through the right-face drain outlet 24*b* or the left-face drain outlet 24*d* by possibly minimally routing the drain hose 36 in the housing 21.

Figure 11:
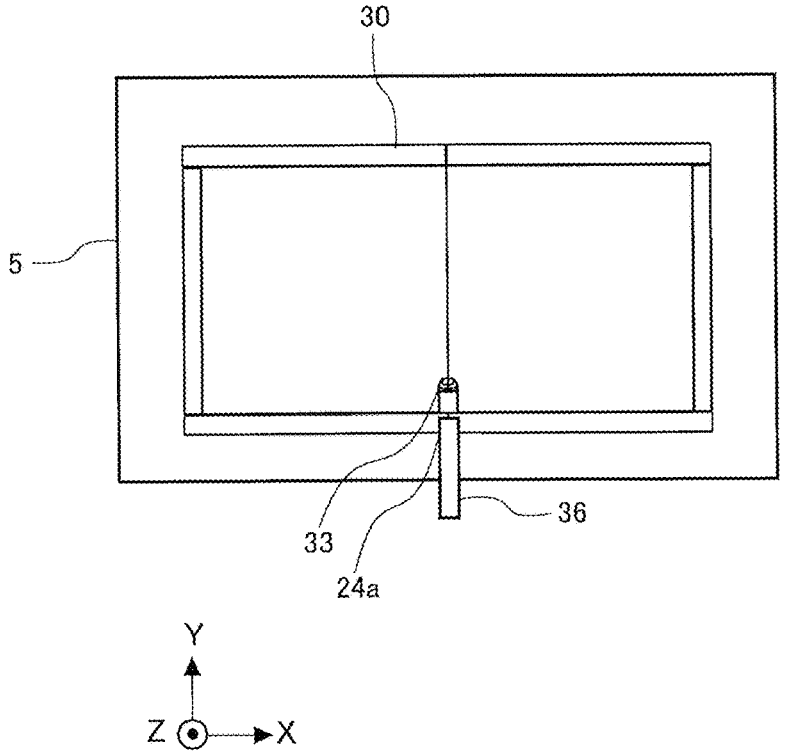
FIG. 11 is a schematic plan view illustrating the horizontal cross section of the lower portion of the relay unit according to Embodiment 1 when the drain hose is led out through the front face.
Figure 12:
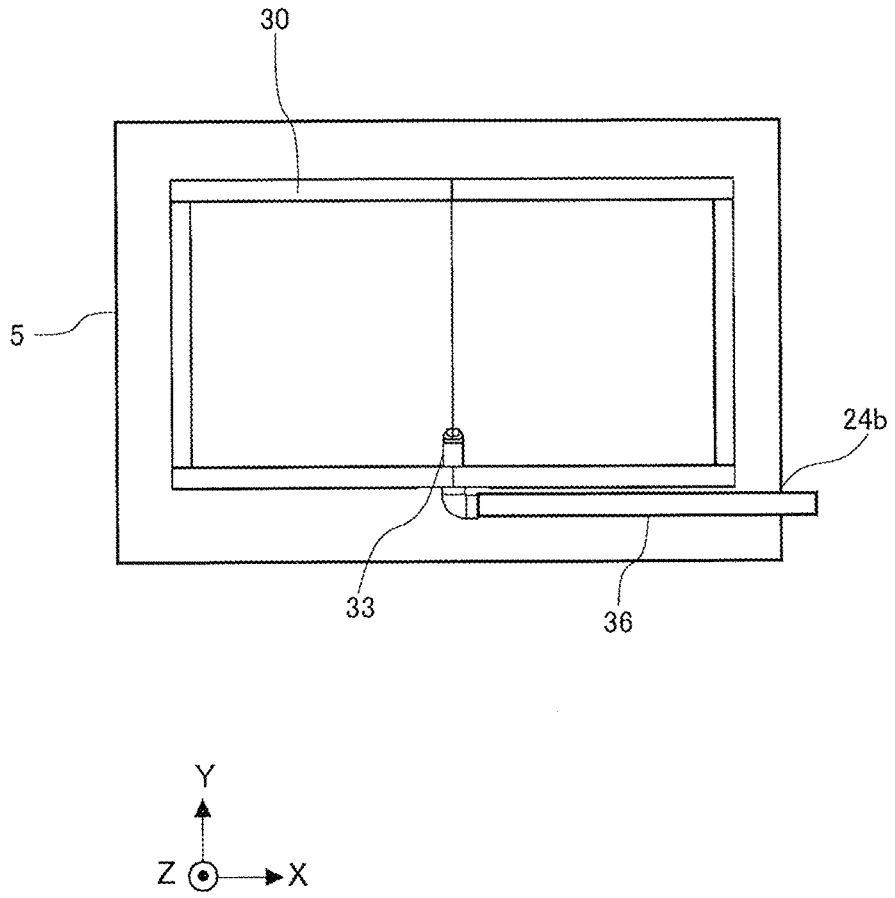
FIG. 12 is a schematic plan view illustrating the horizontal cross section of the lower portion of the relay unit according to Embodiment 1 when the drain hose is led out through the right face.
Figure 13:
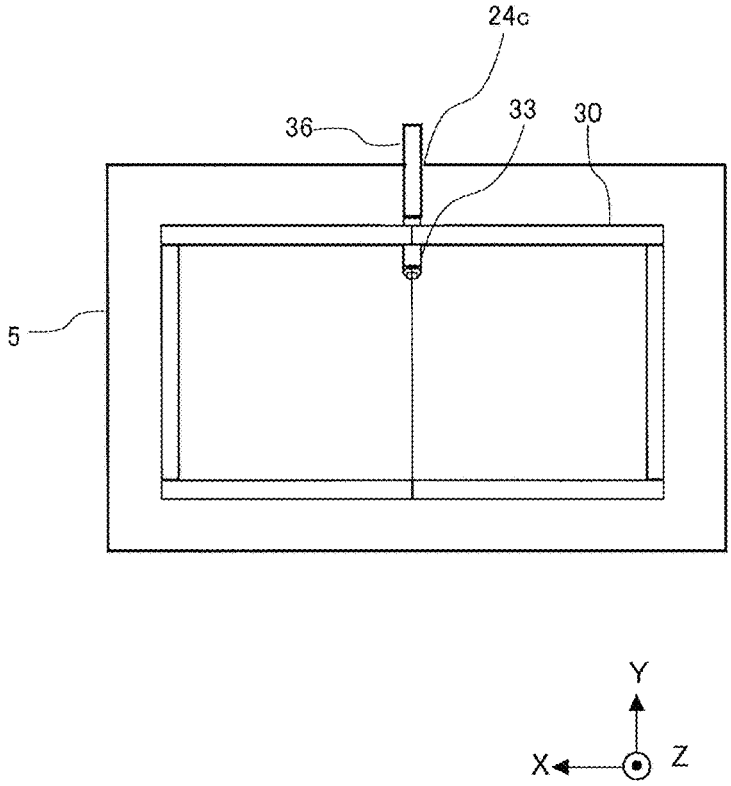
FIG. 13 is a schematic plan view illustrating the horizontal cross section of the lower portion of the relay unit according to Embodiment 1 when the drain hose is led out through the rear face.
Figure 14:
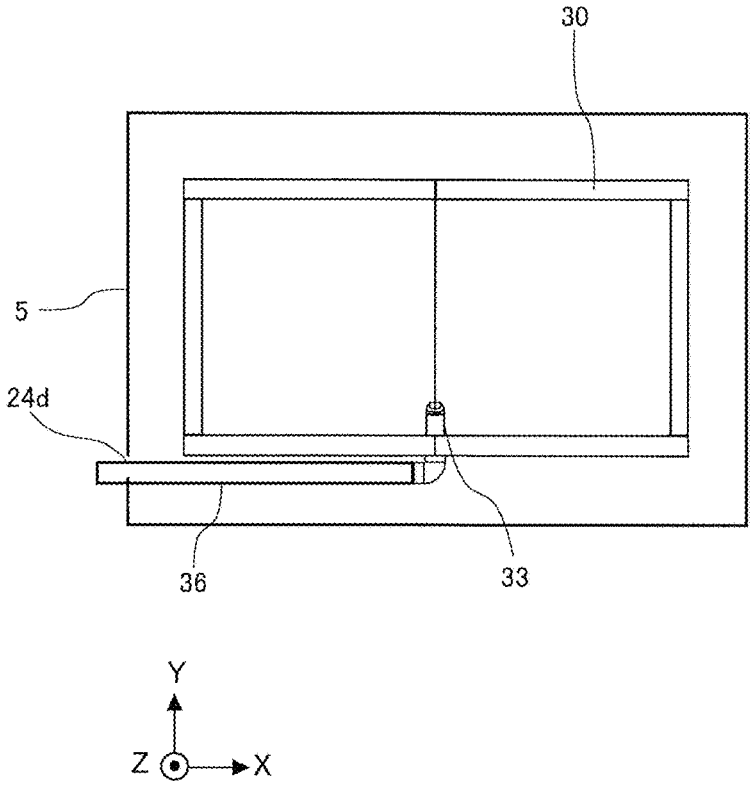
FIG. 14 is a schematic plan view illustrating the horizontal cross section of the lower portion of the relay unit according to Embodiment 1 when the drain hose is led out through the left face.

FIG. 11 is a schematic plan view illustrating the horizontal cross section of the lower portion 2A of the relay unit 2 according to Embodiment 1 when the drain hose is led out through the front face. FIG. 12 is a schematic plan view illustrating the horizontal cross section of the lower portion 2A of the relay unit 2 according to Embodiment 1 when the drain hose is led out through the right face. FIG. 13 is a schematic plan view illustrating the horizontal cross section of the lower portion 2A of the relay unit 2 according to Embodiment 1 when the drain hose is led out through the rear face. FIG. 14 is a schematic plan view illustrating the horizontal cross section of the lower portion 2A of the relay unit 2 according to Embodiment 1 when the drain hose is led out through the left face.

As described above, the outlets are formed individually in the four side faces of the lower portion of the housing 21 so that the drain hose 36 attached to the drain socket 33 of the drain pan 30 can be led out to the outside of the housing 21 through each of the outlets.

In a case where the drain hose 36 is led out through the front-face drain outlet 24*a* in the front face, the drain pan 30 is accommodated in the housing 21 such that the drain socket 33 is located forward as illustrated in FIG. 11. Then, one end of the drain hose 36 is connected to the drain socket 33, while the other end of the drain hose 36 is inserted through the front-face drain outlet 24*a* and is led out to the outside.

In a case where the drain hose 36 is led out through the right-face drain outlet 24*b* in the right face, the drain pan 30 is accommodated in the housing 21 such that the drain socket 33 is located forward as illustrated in FIG. 12. Then, one end of the drain hose 36 is connected to the drain socket 33, while the other end of the drain hose 36 is inserted through the right-face drain outlet 24*b* and is led out to the outside.

In a case where the drain hose 36 is led out through the rear-face drain outlet 24*c* in the rear face, the drain pan 30 is accommodated in the housing 21 such that the drain socket 33 is located rearward as illustrated in FIG. 13. Then, one end of the drain hose 36 is connected to the drain socket 33, while the other end of the drain hose 36 is inserted through the rear-face drain outlet 24*c* and is led out to the outside.

In a case where the drain hose 36 is led out through the left-face drain outlet 24*d* in the left face, the drain pan 30 is accommodated in the housing 21 such that the drain socket 33 is located forward as illustrated in FIG. 14. Then, one end of the drain hose 36 is connected to the drain socket 33, while the other end of the drain hose 36 is inserted through the left-face drain outlet 24*d* and is led out to the outside.

The relay unit 2 according to Embodiment 1 described above includes the housing 21 with a box shape, the housing 21 having a lower portion having four side faces and an outlet formed in each of the four side faces, the heat exchanger 4 accommodated in the housing 21, and the drain pan 30 located below the heat exchanger 4 to receive the drain water 60. At the front face of the lower portion of the housing 21, the sheet metal cover 23 in which the outlet is formed is provided such that the sheet metal cover 23 is removable. The drain pan 30 includes the plate 31 with a rectangular shape, the plate 31 having four side portions, the side wall portions 32, each of which extends upward from the corresponding one of the four side faces of the plate 31, and the drain socket 33 provided in the side wall portion 32 located forward or rearward, and to which the drain hose 36 is connected. The drain pan 30 is accommodated in the housing 21 such that the drain pan 30 is freely inserted and removed in the front-rear direction in a state in which the sheet metal cover 23 is removed from the housing 21. The drain pan 30 is freely reversed front to rear to be accommodated in the housing 21.

In the relay unit 2 according to Embodiment 1, outlets are formed individually in the four side faces of the lower portion of the housing 21. At the time of accommodating the drain pan 30 in the housing 21 in a state in which the sheet metal cover 23 is removed from the housing 21, the drain pan 30 can be reversed front to rear to be accommodated in the housing 21. The drain pan 30 can be reversed front to rear so that the drain hose 36 connected to the drain socket 33 of the drain pan 30 can be led out through either the outlet in the front face or the outlet in the rear face of the housing 21. As a result, even at a location that requires the drain water 60 to be discharged from the front side or rear side of the housing 21, the relay unit 2 can still be installed without involving burdensome work.

In the relay unit 2 according to Embodiment 1, the plate 31 is provided with a downward slope toward the drain socket 33. In the relay unit 2 according to Embodiment 1, this structure helps easily guide the drain water 60 accumulating on the plate 31 to the drain socket 33. Even when the drain socket 33 is provided in only one of the four side wall portions 32, it is still possible to discharge the drain water 60 from the drain socket 33. Furthermore, regardless of the orientation of the drain pan 30 accommodated in the housing 21, it is possible to guide the drain water 60 accumulating on the plate 31 to the drain socket 33.

In the relay unit 2 according to Embodiment 1, the outlet formed in the sheet metal cover 23 is formed at a location where this outlet faces the drain socket 33 in a state in which the drain pan 30 is accommodated in the housing 21 such that the drain socket 33 is located forward. The outlet formed in the rear face of the lower portion of the housing 21 is formed at a location where this outlet faces the drain socket 33 in a state in which the drain pan 30 is accommodated in the housing 21 such that the drain socket 33 is located rearward.

In the relay unit 2 according to Embodiment 1, it is possible to lead out the drain hose 36 to the outside of the housing 21 through the outlet formed in the front face of the lower portion of the housing 21 or the outlet formed in the rear face of the lower portion of the housing 21 by possibly minimally routing the drain hose 36 in the housing 21.

In the relay unit 2 according to Embodiment 1, the space 27 is provided between the sheet metal cover 23 and the drain pan 30 to run the drain hose 36 in the left-right direction.

In the relay unit 2 according to Embodiment 1, the drain hose 36 runs through the space 27 in a state in which the drain pan 30 is accommodated in the housing 21 such that the drain socket 33 is located forward so that it is possible to lead out the drain hose 36 through either of the right-face drain outlet 24*b* and the left-face drain outlet 24*d* in the lower portion of the housing 21. As a result, it is unnecessary to accommodate the drain pan 30 in the housing 21 such that the drain socket 33 is located rightward or leftward. It is also unnecessary to run the drain hose 36 along the outside of the housing 21. This eliminates the need for securing the space on the outside of the housing 21 to run the drain hose 36.

In the relay unit 2 according to Embodiment 1, the outlet formed in the right face of the lower portion of the housing 21, and the outlet formed in the left face of the lower portion of the housing 21 are located on the forward side of the lower portion of the housing 21.

In the relay unit 2 according to Embodiment 1, it is possible to lead out the drain hose 36 to the outside of the housing 21 through the outlet formed in the right face of the lower portion of the housing 21 or the outlet formed in the left face of the lower portion of the housing 21 by possibly minimally routing the drain hose 36 in the housing 21.

Figure 15:
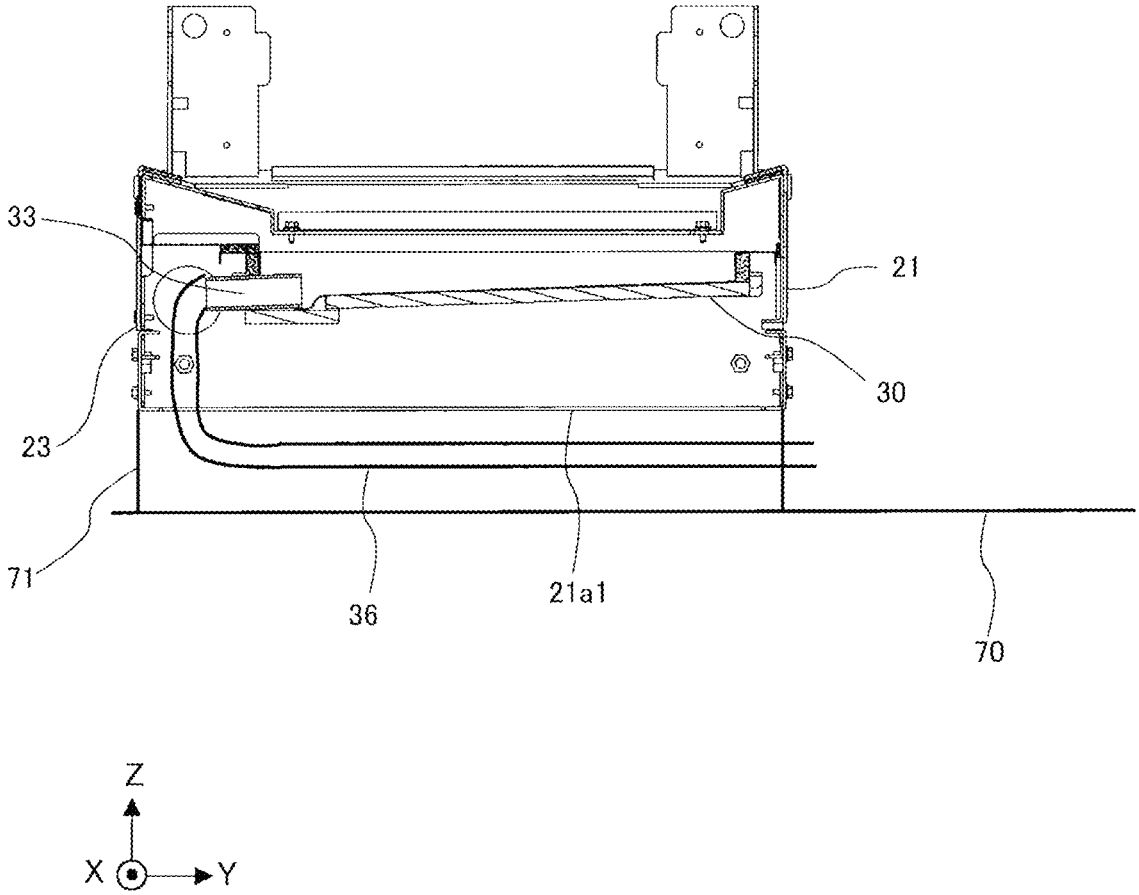
FIG. 15 illustrates an example of the method for leading out the drain hose of the relay unit according to Embodiment 1.

FIG. 15 illustrates an example of the method for leading out the drain hose 36 of the relay unit 2 according to Embodiment 1. Note that FIG. 15 is a schematic diagram illustrating the vertical cross section of the lower portion 2A of the relay unit 2 and the vicinity of the lower portion 2A in side view.

As described above, the hollow portion 21*a*1 is formed in the bottom face 21*a* of the housing 21. Accordingly, as illustrated in FIG. 15, when the relay unit 2 is placed on a placement base 71 such as a platform and installed with a clearance from an installation face 70 such as a floor, it is possible to lead out the drain hose 36 to the underside of the housing 21 through the hollow portion 21*a*1 of the bottom face 21*a*. As a result, it is possible to bring all the four side faces of the housing 21 into contact with the wall surfaces so that the relay unit 2 can be installed even in a narrow space surrounded by walls. Note that the relay unit 2 according to Embodiment 1 may also employ a configuration, in which the bottom face 21*a* of the housing 21 is provided with leg portions extending downward to define a space between the bottom face 21*a* and the installation face 70 to run the drain hose 36 through the space.

In the relay unit 2 according to Embodiment 1 described above, the hollow portion 21*a*1 is formed in the bottom face 21*a* of the housing 21. In the relay unit 2 according to Embodiment 1, when the relay unit 2 is placed on the placement base 71 such as a platform and installed with a clearance from the installation face 70 such as a floor, it is possible to lead out the drain hose 36 to the underside of the housing 21 through the hollow portion 21*a*1 of the bottom face 21*a* of the housing 21. Consequently, it is possible to bring all the four side faces of the housing 21 into contact with the wall surfaces so that the relay unit 2 can be installed even in a narrow space surrounded by walls.

REFERENCE SIGNS LIST

1: outdoor unit, 2: relay unit, 2A: lower portion, 3: indoor unit, 4: heat exchanger, 5: flow switching device, 5*a*: flow switching circuit, 6: pump, 21: housing, 21*a*: bottom face, 21*a*1: hollow portion, 21*a*2: lower end portion, 22: front panel, 23: sheet metal cover, 24*a*: front-face drain outlet, 24*b*: right-face drain outlet, 24*c*: rear-face drain outlet, 24*d*: left-face drain outlet, 24*e*: bottom-face drain outlet, 27: space, 28: primary heat medium pipe, 29: secondary heat medium pipe, 30: drain pan, 31: plate, 32: side wall portion, 33: drain socket, 36: drain hose, 60: drain water, 70: installation face, 71: placement base, 100: air-conditioning apparatus

The invention claimed is:

1. A relay unit comprising:

a housing with a box shape, the housing having a lower portion having four side faces and an outlet formed in each of the four side faces;

a heat exchanger accommodated in the housing; and a drain pan located below the heat exchanger to receive drain water, at a front face of the lower portion of the housing, a sheet metal cover in which the outlet is formed being provided such that the sheet metal cover is removable, the drain pan including a plate with a rectangular shape, the plate having four side portions, a side wall portion extending upward from each of the four side portions of the plate, and a drain socket provided in the side wall portion located forward or rearward, and configured to be connected to a drain hose, the drain pan being accommodated in the housing such that the drain pan is freely inserted and removed in a front-rear direction in a state in which the sheet metal cover is removed from the housing and the drain hose is not connected to the drain socket, the drain pan being freely reversed front to rear to be accommodated in the housing when the drain hose is not connected to the drain socket, the outlet formed in the sheet metal cover being formed at a location where the outlet faces the drain socket in a state in which the drain pan is accommodated in the housing such that the drain socket is located forward, and a space being provided between the sheet metal cover and the drain pan to run the drain hose in a left-right direction.

2. The relay unit of claim 1, wherein the plate is provided with a downward slope toward the drain socket.

3. A relay unit comprising:

a housing with a box shape, the housing having a lower portion having four side faces and an outlet formed in each of the four side faces;

a heat exchanger accommodated in the housing; and a drain pan located below the heat exchanger to receive drain water, at a front face of the lower portion of the housing, a sheet metal cover in which the outlet is formed being provided such that the sheet metal cover is removable, the drain pan including a plate with a rectangular shape, the plate having four side portions, a side wall portion extending upward from each of the four side portions of the plate, and a drain socket provided in the side wall portion located forward or rearward, and configured to be connected to a drain hose, the drain pan being accommodated in the housing such that the drain pan is freely inserted and removed in a front-rear direction in a state in which the sheet metal cover is removed from the housing and the drain hose is not connected to the drain socket, the drain pan being freely reversed front to rear to be accommodated in the housing when the drain hose is not connected to the drain socket, the outlet formed in a rear face of the lower portion of the housing being formed at a location where the outlet faces the drain socket in a state in which the drain pan is accommodated in the housing such that the drain socket is located rearward, and a space being provided between the sheet metal cover and the drain pan to run the drain hose in a left-right direction.

4. A relay unit comprising:

a housing with a box shape, the housing having a lower portion having four side faces and an outlet formed in each of the four side faces;

a heat exchanger accommodated in the housing; and a drain pan located below the heat exchanger to receive drain water, at a front face of the lower portion of the housing, a sheet metal cover in which the outlet is formed being provided such that the sheet metal cover is removable, the drain pan including a plate with a rectangular shape, the plate having four side portions, a side wall portion extending upward from each of the four side portions of the plate, and a drain socket provided in the side wall portion located forward or rearward, and configured to be connected to a drain hose, the drain pan being accommodated in the housing such that the drain pan is freely inserted and removed in a front-rear direction in a state in which the sheet metal cover is removed from the housing and the drain hose is not connected to the drain socket, the drain pan being freely reversed front to rear to be accommodated in the housing when the drain hose is not connected to the drain socket, a space being provided between the sheet metal cover and the drain pan to run the drain hose in a left-right direction.

5. The relay unit of claim 4, wherein the outlet formed in a right face of the lower portion of the housing, and the outlet formed in a left face of the lower portion of the housing are located on a forward side of the lower portion of the housing.

6. The relay unit of claim 1, wherein a hollow portion is formed in a bottom face of the housing.

7. An air-conditioning apparatus comprising:

a heat source side unit configured to generate a heat source;

a load side unit configured to use the heat source generated by the heat source side unit; and the relay unit of claim 1.

8. The relay unit of claim 2, wherein a hollow portion is formed in a bottom face of the housing.

9. The relay unit of claim 3, wherein a hollow portion is formed in a bottom face of the housing.

10. The relay unit of claim 4, wherein a hollow portion is formed in a bottom face of the housing.

11. The relay unit of claim 5, wherein a hollow portion is formed in a bottom face of the housing.

12. An air-conditioning apparatus comprising:

a heat source side unit configured to generate a heat source;

a load side unit configured to use the heat source generated by the heat source side unit; and the relay unit of claim 2.

13. An air-conditioning apparatus comprising:

a heat source side unit configured to generate a heat source;

a load side unit configured to use the heat source generated by the heat source side unit; and the relay unit of claim 3.

14. An air-conditioning apparatus comprising:

a heat source side unit configured to generate a heat source;

a load side unit configured to use the heat source generated by the heat source side unit; and the relay unit of claim 4.

15. An air-conditioning apparatus comprising:

a heat source side unit configured to generate a heat source;

a load side unit configured to use the heat source generated by the heat source side unit; and the relay unit of claim 5.

16. An air-conditioning apparatus comprising:

a heat source side unit configured to generate a heat source;

a load side unit configured to use the heat source generated by the heat source side unit; and the relay unit of claim 6.

* * * * *